US009534777B2

(12) United States Patent
Van Herpen

(10) Patent No.: US 9,534,777 B2
(45) Date of Patent: Jan. 3, 2017

(54) CARPET UNIT ARRANGEMENT HAVING A LIGHT SOURCE

(75) Inventor: Maarten Marinus Johannes Wilhelmus Van Herpen, Heesch (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/007,985

(22) PCT Filed: Mar. 30, 2012

(86) PCT No.: PCT/IB2012/051541
§ 371 (c)(1),
(2), (4) Date: Sep. 27, 2013

(87) PCT Pub. No.: WO2012/137115
PCT Pub. Date: Oct. 11, 2012

(65) Prior Publication Data

US 2014/0016307 A1 Jan. 16, 2014

(30) Foreign Application Priority Data

Apr. 7, 2011 (EP) ..... 11161531

(51) Int. Cl.
*F21V 33/00* (2006.01)
*D05C 17/02* (2006.01)
(Continued)

(52) U.S. Cl.
CPC ..... *F21V 33/006* (2013.01); *D03D 15/00* (2013.01); *D05C 17/02* (2013.01); *D10B 2401/20* (2013.01); *F21Y 2101/00* (2013.01)

(58) Field of Classification Search
CPC . F21Y 2101/02; F21Y 2101/00; F21V 33/006; G02B 6/0078; G02F 1/133603; F21S 2/005;F21W 2121/00; G09G 5/14; E04F 15/02; E04F 15/02194; E04F 19/06; E04F 2290/026; G09F 19/22; G09F 2013/222; Y10S 362/80; D03D 15/00; D05C 17/02; D10B 2401/20
(Continued)

(56) References Cited

U.S. PATENT DOCUMENTS 4,234,907 A 11/1980 Daniel
7,670,026 B1 * 3/2010 Hawkins ..... 362/249.05
(Continued)

FOREIGN PATENT DOCUMENTS

EP 0261811 A2 3/1988
EP 0323682 A1 7/1989
(Continued)

OTHER PUBLICATIONS

"Weaving Dreams: Types of Carpets, Weaving Methods, and Materials" www.seeingisdreaming.com.
(Continued)

*Primary Examiner* — Stephen F Husar
*Assistant Examiner* — Danielle Allen

(57) ABSTRACT

The invention provides a carpet unit arrangement comprising a carpet unit and a light source. The carpet unit comprises a carpet or a carpet tile, wherein the carpet unit comprises a user face, formed by carpet tuft yarns, and an opposite back face. Seen in a direction from the user face to the back face, the light source is arranged behind the user face of the carpet unit. The light source is further arranged to provide light downstream of the user face of the carpet unit. The carpet unit is an axminster-based carpet unit, comprising wefts, warps and said tuft yarns.

6 Claims, 6 Drawing Sheets

(51) Int. Cl.
*D03D 15/00* (2006.01)
*F21Y 101/00* (2016.01)

(58) Field of Classification Search
USPC ..... 362/249.02, 153, 153.1, 555, 576, 600,362/606, 612, 616; 136/251; 29/428; 349/61; 40/541
See application file for complete search history.

(56) References Cited

U.S. PATENT DOCUMENTS

| | | | | |
|---|---|---|---|---|
| 8,444,294 | B1 * | 5/2013 | Hawkins | 362/234 |
| 2007/0037462 | A1 | 2/2007 | Allen et al. | |
| 2007/0258255 | A1 * | 11/2007 | Kessler et al. | 362/487 |
| 2010/0271805 | A1 | 10/2010 | Van Herpen | |

FOREIGN PATENT DOCUMENTS

| | | | |
|---|---|---|---|
| GB | 1336030 | A | 11/1973 |
| JP | 0856810 | A | 3/1996 |
| JP | 2011504394 | A | 2/2011 |
| WO | 2009066226 | A1 | 5/2009 |
| WO | 2010092506 | A1 | 8/2010 |
| WO | 2010092509 | A1 | 8/2010 |

OTHER PUBLICATIONS

"Weaving Methods", Brintons Fine Carpet www.brintons.net/residential/uk/about-us/weaving-methods.

* cited by examiner

CARPET UNIT ARRANGEMENT HAVING A LIGHT SOURCE

FIELD OF THE INVENTION

The invention relates to a carpet unit arrangement having a lighting function, as well as to a carpet unit for use in such carpet unit arrangement.

BACKGROUND OF THE INVENTION

Carpets with lighting functions are known in the art. EP0323682 for instance describes an apparatus for guiding the occupants of a building along a path of travel within the building, which comprises modular carpet tiles which are abuttingly arranged to cover the floor of the structure, with some of the tiles being signal units having a light-transmissive, molded plastics housing positioned in an opening therein, and having light-emitting diodes positioned in the housing. The light-emitting diodes are energized via an electrical cable, and thereby provide a visually discernable pathway on the floor.

This document especially describes an apparatus for guiding the occupants of a structure in a path of travel along the floor within the structure, comprising a plurality of abuttingly arranged modular floor covering units covering the floor, said modular units having a fibrous face, some of said modular floor covering units being illuminable and arranged in a predetermined pattern resting upon and extending along the floor, each of said illuminable floor covering units having at least one relatively small opening therein spaced inwardly from the sides of said unit and open to the upper surface of the unit, a relatively small light transmissive housing positioned in each of said openings so as to be inset therein and completely surrounded by said fibrous face, light-emitting means positioned within each of said housings, and power means electrically connected to said light-emitting means of said illuminable modular floor covering units so that when said light-emitting means are energized by said power means a visually discernable pathway is defined in the floor by the cooperation of said illuminable modular floor covering units which can then be followed by the occupants of the structure to a predetermined location in the structure.

SUMMARY OF THE INVENTION

Carpets with lighting functions are known in the art. Prior art solutions sometimes substantially harm the integrity of the carpet, by introducing relatively large openings for light sources. Further, prior art solutions suggest options for non-woven carpets. A problem however may be to make a light emitting (woven) carpet, through which light from a light source may be transmitted, without substantially harming the integrity of the (woven) carpet.

Hence, it is an aspect of the invention to provide an alternative carpet unit alone or in combination with a light source, which preferably further at least partly obviates one or more of above-described drawbacks. Hence, it is a first aspect to provide a carpet unit arrangement comprising a carpet unit and a light source, and it is a second aspect to provide such carpet unit per se.

In the art, all kind of carpets and carpet structures are known. With reference to the woven types, it is referred to as Kilim, Cicim, Zili, Sumak, velvet, English, such as axminster or wilton, Persian, Chinese, Armenian, Pakistan, Azerbaijan, Spanish, and French type of woven carpets. It surprisingly appears that especially axminster carpets, optionally with some modifications, are suitable as carpet unit for light applications.

With axminster carpets, it is possible to hide the light source, especially a LED (light emitting diode) behind or within the carpet, substantially not visible by a user when the light source is in the off-state, while nevertheless offering enough transmission to allow light from the light source be perceived by a user when the light source is in the on-state. A further advantage of the light source within or behind the carpet is that the light source may be protected. In contrast to solutions where holes may be made in the carpet, in the present solution, the integrity of the carpet is entirely or substantially remained.

Hence, in a first aspect, the invention provides a carpet unit arrangement comprising (a) a carpet unit and (b) a light source, wherein the carpet unit comprises a carpet or a carpet tile, wherein the carpet unit comprises a user face, formed by carpet tuft yarns, and an opposite back face, wherein, when seen in a direction from the user face to the back face, the light source is arranged behind the user face of the carpet unit, wherein the light source is further arranged to provide light downstream of the user face of the carpet unit, and wherein the carpet unit is an axminster-based carpet unit, comprising wefts, warps and the tuft yarns. Hence, the carpet unit is herein also indicated as "axminster-based carpet unit" or "axminster carpet unit".

As indicated above, with such carpet unit arrangement, a carpet (tile) with a lighting function may be provided, wherein the carpet (tile) may be of high quality and good integrity, the light source may substantially be invisible to a user, i.e. substantially not visible through the user face by the user when the light source is in the off-state. Visibility of the light source or other elements behind the carpet unit may especially not be desired, because the light source (or other elements, like electric wires, reflective foil, a padding) may no longer be hidden. The principle presented here may also be indicated as "hide light": the light source may be hidden and not visible to a user of the carpet unit, while the light generated thereby is visible to the user. An additional advantage of the current invention may be that the carpet unit is protecting the light source. Additionally, this may eliminate the need to use a protective housing for the light source, which may make the lighting system cheaper to produce.

The term "carpet unit" herein refers to a carpet or to carpet tile. For instance, the carpet unit may in an embodiment be a broadloom carpet. The term carpet unit may also refer to a rug or a goblin. The carpet unit is a woven carpet, having wefts and warps, wherein the tuft yarns are embedded. Especially the tuft yarns are cut.

The carpet unit has a user face. This is the face the common user will perceive when the carpet unit is in use as carpet. Hence, this is the face on which people may walk, furniture may be arranged, etc., when the carpet unit is arranged on a floor. The user face is formed by the tuft yarns, i.e. their tops. In general, this will be a substantially even surface, although in an embodiment this may be different for one or more subareas (see below). Opposite of the user face, the carpet unit comprises the back face. This is the face which will in generally be arranged on a floor or on a support on the floor. The distance between the back face and the user face defines the height of the carpet unit, which will in general be in the range of about 0.1-2 cm, especially 0.2-1 cm.

The part of the carpet unit between the light source and the user face, i.e. the part through which light from the light source may travel to emanate from the user face and form carpet unit light preferably has a light transmission for light generated by the light source in the range of 0.1-30%, especially in the range of 0.5-20%. Dependent upon the location of the light source, this may be through the entire (height of the) carpet unit or through part of the (height of the) carpet unit The transmission or light permeability can be determined by providing light at a specific wavelength with a first intensity to the material and relating the intensity of the light at that wavelength measured after transmission through the material, to the first intensity of the light provided at that specific wavelength to the material (see also E-208 and E-406 of the CRC Handbook of Chemistry and Physics, 69th edition, 1088-1989).

Transmission is measured of light travelling through the carpet unit from the light source to the user face. The intensity of the light downstream of the user face is related to the intensity of the light from the light source. The total integrated light emission on the other side of the user face is measured. In case where the light source is arranged upstream of the back side, the transmission of the light through the carpet unit from back side to user face may be measured. The light shed on the back side for determining transmission is preferably directed on the back side under normal incidence.

In this way, the light source is arranged behind the user face of the carpet unit, and the light source is further arranged to provide light downstream of the user face of the carpet unit. Thus, the carpet unit, in the carpet unit arrangement of the invention, may be used for lighting functions. Such carpet unit arrangement may thus be used to provide floor, wall or ceiling light, i.e. light emanating from the carpet unit (when one or more the light source(s) of the lighting system are switched on). The lighting of the carpet unit arrangement may be used to light rooms or areas, but may also be used as functional or decorative lighting. The lighting may alternatively or additionally also be used to provide information, like commercial information (trademarks, trade names, prices, etc.), other information (like time, temperature, date), and way finding information, such as directions for finding shops, rooms, entrances, exits, or areas. Especially, the carpet unit arrangement may also be used to provide emergency way finding. Hence, the invention also provides the carpet unit arrangement as described herein for way guiding, especially for emergency way guiding. Therefore, such carpet unit arrangement may in an embodiment also be used to provide information with the light, i.e. especially create a lighting pattern on the floor, wall or ceiling (like an arrow, etc.).

As indicated above, in an embodiment the light source is arranged behind the carpet unit. Therefore, in an embodiment, when seen in a direction from the user face to the back face, the light source is arranged behind the back face. Especially in such embodiment, the light source is arranged to illuminate the back face. The back face in this embodiment may be a closed back face. Here, closed is used in the sense that no holes are created in the back face, as in some prior art solutions is suggested (i.e. not holes in addition to any holes that may exist in the normal carpet structure). Hence, in such embodiment the light of the light source travels through the weave and the tuft yarns and emanates from the user face.

In another embodiment, the light source is embedded in the carpet unit. For instance, in an embodiment, the light source is arranged between adjacent tuft yarns. In an embodiment, the light source is embedded in the weave structure. Hence, the invention also provides an axminster-based carpet unit further comprising a light source embedded in the carpet unit, especially a LED light source.

The term "light source" may in an embodiment also refer to a plurality of light sources. Hence, the carpet unit arrangement may comprise a plurality of light sources, especially LED (light emitting diode) light sources. The term "plurality of light sources" may refer to 2 or more light sources (especially LEDs), especially 2-100,000, for instance 2-10,000, like 4-300, such as 16-256. Hence, the carpet unit or carpet unit arrangement may comprise a plurality of LEDs. In general, the carpet unit or carpet unit arrangement may comprise 2-10,000 LEDs/$m^2$, especially 25-2,500 LEDs/$m^2$. One or more of those light sources might be embedded and/or one or more of the light sources may be arranged behind the back face.

The light source(s) may comprise any light source, such as a small incandescent lamp or a fiber tip or fiber irregularity (arranged to let light escape from the fiber, which embodiment has the advantage that it is relatively cheap), but may especially comprise a LED (as light source). In general, the light source will be configured to provide visible light, i.e. especially light having a wavelength selected from the range of 380-780 nm, although in an embodiment the light source may alternatively or additionally be configured to provide UV light. In general however, the light source will be configured to generate visible light. When using a plurality of light sources, optionally two or more subsets of light sources may be configured to generate light with different wavelength distributions, for instance one subset may be configured to generate blue light, one subset may be configured to generate green light, one subset may be configured to generate yellow light and one subset may be configured to generate red light. Of course, other options and combinations may be also possible.

It may be desirable to (further) control transmission through the carpet. One or more solutions thereto are provided below, which may be used independently or which may be combined.

In an embodiment, one or more of a weft and a warp comprise a light transmissive fiber, such as an optical fiber. As will be clear to the person skilled in the art, this includes also embodiments wherein one or more of (a) one or more wefts, and (b) one or more warps comprise light transmissive fibers (such as optical fibers). In other words, a warp or a weft, or a warp and a weft, or one more warps and/or one or more wefts may be replaced by an light transmissive fiber. In this way, transparency may be increased. Especially, the invention provides an embodiment of the carpet unit wherein one or more wefts comprise one or more light transmissive fibers, such as optical fibers. The transmission of such light transmissive fibers may be larger than 50%.

Independently thereof or combined therewith, in an embodiment the carpet unit comprises a first area with a first tuft yarn density and second area with a second tuft yarn density, the first tuft yarn density being smaller than the second tuft yarn density, wherein the first area and the light source are aligned to each other. For instance, the yarn density may locally be decreased by not placing one or more tuft yarns. Preferably however, the integrity of the user face is maintained. In this embodiment, the appearance of the carpet unit may not have changed, but its light transmissivity may substantially be increased. Hence, in an embodiment, the light source may be arranged upstream of a first area with a reduced tuft yarn density, relative to the mean tuft yarn density of the carpet unit. The area with the lower tuft yarn density may especially be configured to allow transmission of light of the light source. In an embodiment, the light source may be arranged behind the area with the lower tuft yarn density. In another embodiment, the light source may be embedded in the carpet unit within the area with the lower tuft yarn density. For instance, in an embodiment, the light source is arranged at a location of a tuft yarn (i.e. a tuft yarn (or a plurality of tuft yarns) is replaced by a light source, especially a LED). Nevertheless, the appearance of the carpet unit may not substantially be changed, and thus keeping the light source "hidden".

Independently thereof, or optionally combined with one or more of the former embodiments, the invention also provides an embodiment wherein the carpet unit comprises first area with one or more tuft yarns of a first tuft yarn length and second area with tuft yarns of a second tuft yarn length, the first tuft yarn length being smaller than the second tuft yarn length, wherein the first area and the light source are aligned to each other. In this embodiment, the appearance of the carpet unit and its robustness may not have changed, but its light transmissivity may substantially be increased. Hence, in an embodiment, the light source may be arranged upstream of one or more tuft yarns having a reduced tuft yarn length relative to the user face. The area with the shorter tuft yarn length may especially be configured to allow transmission of light of the light source. In an embodiment, the light source may be arranged behind the area with the shorter tuft yarn length.

As indicated above, embodiments may be combined, and in principle within one carpet unit, there may be one or more first areas of the first type (lower density) and one or more of the second type (lower tuft yarn length). Especially, the total area (i.e. when more of such areas are present, the cumulated area) with altered density and/or tuft yarn length is equal to or less than 20% of the total user face area, especially equal to or less than 10% of the total user face area.

Independently thereof, or optionally combined with one or more of the former embodiments, the invention also provides an embodiment wherein the carpet unit comprises tuft yarns being transmissive. For instance, instead of some normal tuft yarns, transmissive fibers may be used. This may be done locally, i.e. creating a locally more transparent (first) area, but this may also be done all over the carpet. Again, the transmission of such light transmissive fibers as tuft yarns may be larger than 50%.

Independently thereof, or optionally combined with one or more of the former embodiments, the invention also provides an embodiment wherein the carpet unit further comprises an adhesive containing backing, wherein the adhesive containing backing is transmissive for light of the light source. The light source might be behind the adhesive containing backing, but may optionally also (partly) penetrate the adhesive containing backing. The adhesive may especially be designed to have a good transmission. Also in this way, transmission through (at least part of) the carpet unit may be promoted.

As indicated above, the carpet unit arrangement may comprise a plurality of light sources. All kind of above-mentioned embodiments may be combined, with one or more light sources behind the back face, with one or more light sources embedded in the carpet unit, with one or more light sources embedded in (one or more) first areas with reduced tuft yarn density, etc. etc.

In a further aspect, the invention also provides an axminster-based carpet unit per se, especially for use in the carpet unit arrangement as defined herein, wherein the carpet unit comprises a carpet or a carpet tile. The above-mentioned embodiments, which have especially been described with relation to the carpet unit arrangement also apply to the carpet unit per se. Hence, in an embodiment, one or more of a weft and a warp comprise an light transmissive fiber, such as optical fibers. Especially, one or more wefts comprise one or more light transmissive fibers (like optical fibers). Further, in an embodiment, the axminster-based carpet unit comprises a first area with a first tuft yarn density and second area with a second tuft yarn density, the first tuft yarn density being smaller than the second tuft yarn density. Yet, in a further embodiment, the axminster-based carpet unit comprises a first area with one or more tuft yarns of a first tuft yarn length and second area with tuft yarns of a second tuft yarn length, the first tuft yarn length being smaller than the second tuft yarn length, wherein the first area and the light source are aligned to each other. In yet a further embodiment, the axminster-based carpet unit further comprises an adhesive containing backing, wherein the adhesive containing backing is transmissive for light. As indicated above, the light source(s) may be embedded in the carpet unit, which provides the carpet unit arrangement per se.

The terms "upstream" and "downstream" relate to an arrangement of items or features relative to the propagation of the light from a light generating means (here especially the light source), wherein relative to a first position within a beam of light from the light generating means, a second position in the beam of light closer to the light generating means is "upstream", and a third position within the beam of light further away from the light generating means is "downstream".

The term "substantially" herein, such as in "substantially all emission" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily on scale.

DETAILED DESCRIPTION OF THE EMBODIMENTS

Figure 1A:
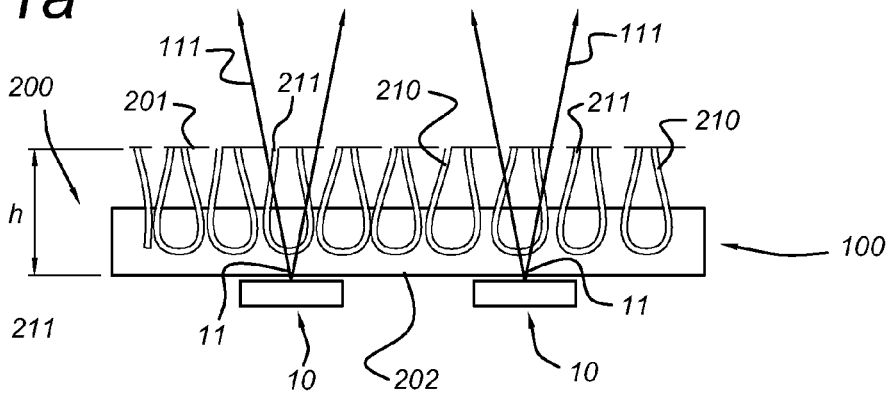
FIGS. 1*a*-1*c* schematically depict some embodiments of the carpet unit arrangement.
Figure 1B:
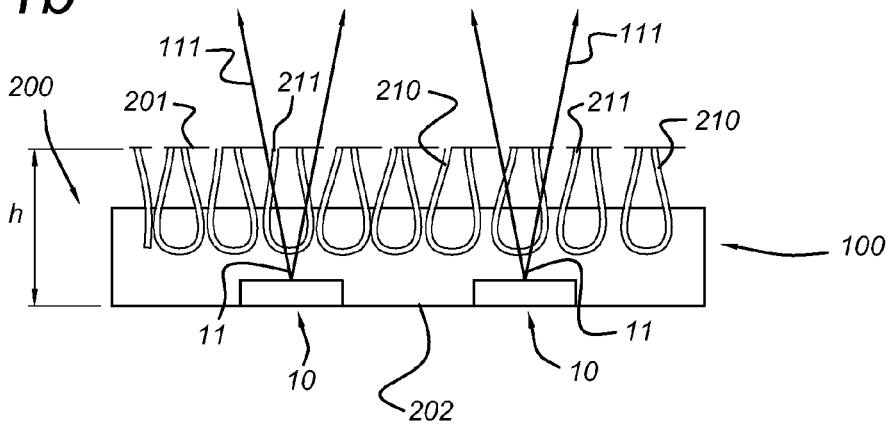
Figure 1C:
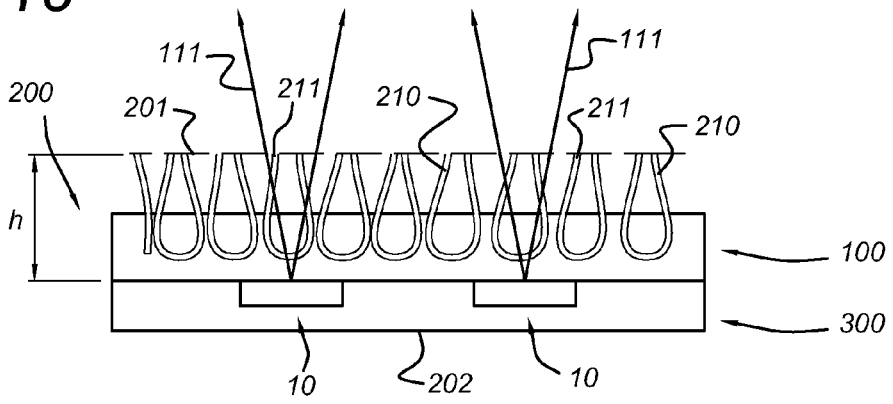

FIGS. 1*a*-1*c* schematically depict a number of possible embodiment of the carpet unit arrangement according to the invention. The carpet unit arrangement is indicated with reference 100. The carpet unit arrangement 100 comprises (a) a carpet unit 200 and (b) a light source 10. By way of example, two light sources 10 are indicated, to further illustrate that the term "light source" may in an embodiment also refer to a plurality of light sources. As indicted above, the carpet unit 200 per se is also part of the invention.

The carpet unit 200 comprises a carpet or a carpet tile. The carpet unit 200 comprises a user face 201, formed by carpet tuft yarns 210 (especially their tops 211) and an opposite back face 202. The height of the carpet unit 200 is indicated with reference h and is the height between the back face 202 and the user face 201. In general, the carpet unit 200 will be arranged on a floor, with the back face 202 on the floor or on a support on the floor.

Alternatively, or additionally, the carpet is also mounted to a wall. For example, a floor carpet may extend near the floor over the wall, in order to serve as a carpet baseboard. It is advantageous to install the lighting unit behind a carpet baseboard, because the lighting unit will experience less stress due to people walking over it. A user will in general only perceive the user face 201, when the carpet unit 200 is in use as carpet unit.

Seen in a direction from the user face 201 to the back face 202, the light source 10 is arranged behind the user face 201 of the carpet unit 200. In FIG. 1*a* this implies that the light source 10 is arranged behind the back face 202, and is configured to illuminate at least part of the back face 202 with light source light 11. In FIG. 1*b* this implies that the light source(s) 10 are embedded in the carpet unit 200, but still arranged behind the user face 201. In FIG. 1*c* this implies that the light source(s) 10 are part of a support 300, which may be a support layer for the carpet unit and/or which may be a lighting system (underneath at least part of the carpet unit 200). Note that in FIG. 1*b*, wherein the light sources 10 are embedded in the carpet unit 200, the carpet unit 200 and carpet unit arrangement 100 may in fact be the same item.

The light source 10, when switched on, provides light source light 11, which penetrates through the carpet unit 200 (FIGS. 1*a* and 1*c*) or through at least part of the carpet unit 200 (FIG. 1*b*). Light emanating from the carpet unit 200, i.e. escaping from the user face 201 is indicated with reference 111. Reference 111 may also be indicated as carpet unit arrangement light. The carpet unit 200 is transmissive for at least part of the light source light 11, in order to allow generation of said carpet unit arrangement light 111.

Hence, those schematic drawings show that the light source 10 is arranged to provide light 111 downstream of the user face 201 of the carpet unit 200. However, when the light source(s) 10 is (are) switched off, the light source(s) is (are) preferably not visible to a user, due to the fact that the light source(s) is (are) hidden behind the user face 201 formed by the (tops of the) tuft yarns 210.

To further illustrate the terms "upstream" and "downstream": in FIG. 1*a*, the light sources 10 are upstream of the back face 202 and upstream of the user face 201. The back face 202 is downstream of the light sources 10, but upstream of the user face 201. Light 111 emanating from the user face 201 is downstream of the user face 201.

Figure 2A:
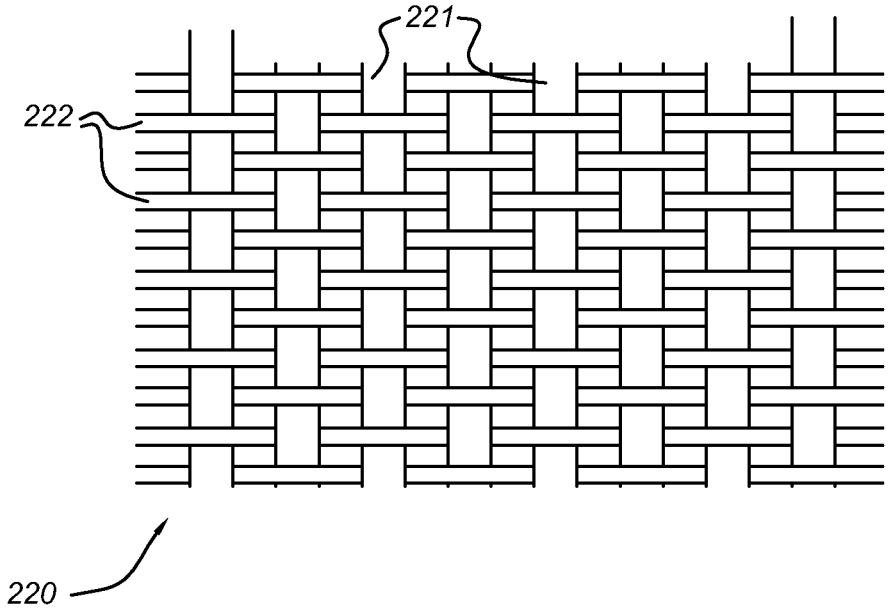
FIGS. 2*a*-2*c* schematically depict some aspects of a woven carpet unit, especially an axminster carpet unit.
Figure 2B:
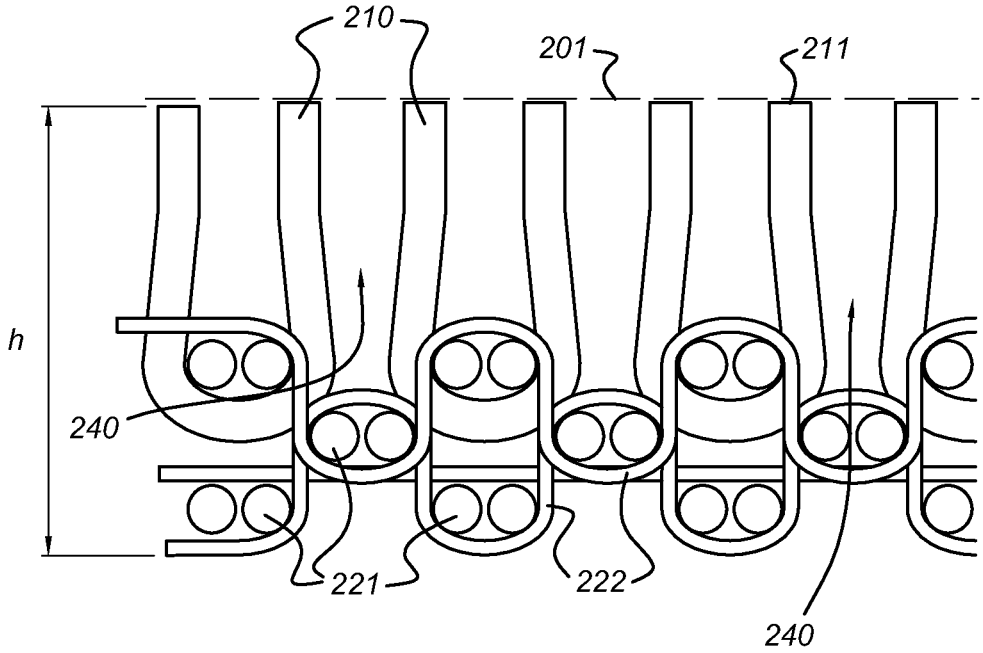
Figure 2C:
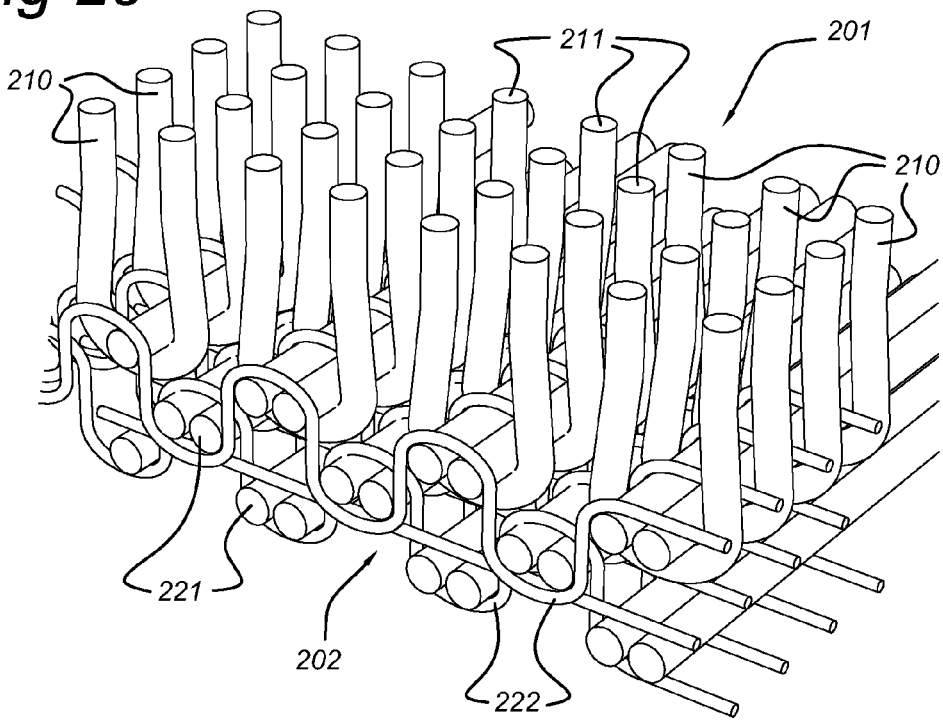

Besides the tuft yarns 210, the axminster-based carpet unit 200 comprises wefts and warps, wherein the tuft yarns 210 are integrated. FIGS. 2*a*-2*c* depict in more detail some principles of woven carpets, especially of the axminster-based carpet unit 200 of the invention.

FIG. 2*a* schematically depicts an embodiment of the backbone or weave structure of a woven carpet with warp and weft in plain weaving. The wefts are indicated with reference 221 and the warps are indicated with reference 222. Reference 220 indicates the weave structure.

FIG. 2*b* very schematically depicts a part of an embodiment of an axminster based carpet unit 200. It shows the integration or embedment of the tuft yarns 210 in the weave structure 220 of the wefts 221 and warps 222. An interesting aspect of the axminster-based carpet unit is the fact that there may be some inherent (small) openings or holes between tuft yarns 210, which is indicated with the arrow 240. For instance, this is not the case with wilton based carpets or some other types of carpets. Without the desire to be bound by any theory, this feature of axminster carpets might be the reason of the relative good transmission of light through the axminster based carpet unit 200. Different tuft yarns 210 may in an embodiment have different colors. FIG. 2*c* schematically depicts a 3D view of an axminster based carpet unit 200; wefts 221, warps 222 and the embedded tuft yarns 210 are clearly visible.

Figure 3A:
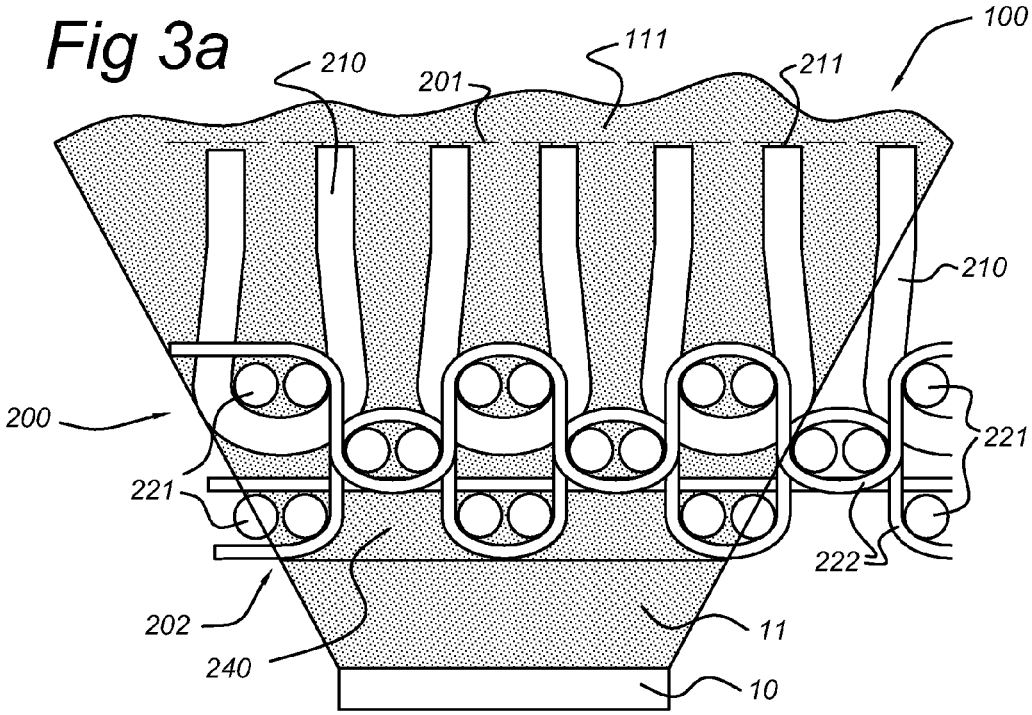
FIGS. 3*a*-3*f* schematically depict some specific embodiment of the carpet unit of the invention.

FIG. 3*a* schematically depicts an embodiment of the carpet unit arrangement 100, with light source 10 arranged behind the carpet unit 200. Light 11 of the light source 10 may be transmitted and may escape from the user face 201 as carpet unit arrangement light 111. This is an embodiment, wherein the light source 10 illuminates part of the back face 202, and wherein, unlike in some prior art solutions, there is no necessity to harm the integrity of the carpet unit (such as of the back face 202).

Figure 3B:
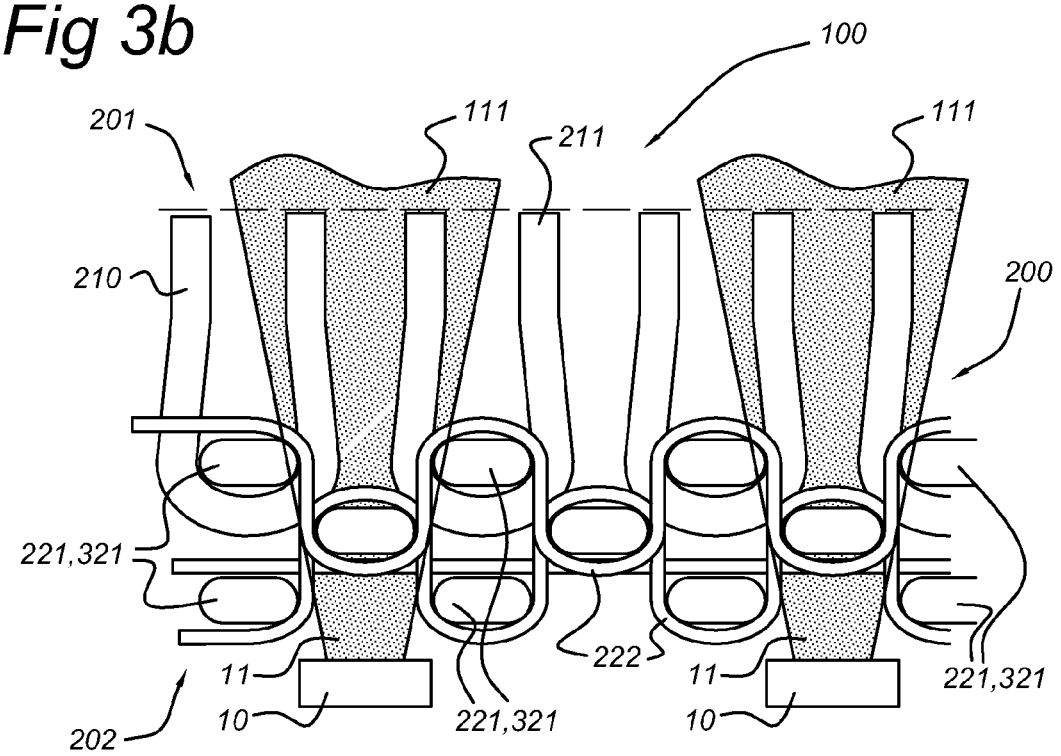

FIG. 3*b* schematically depicts an embodiment wherein one or more wefts 221 are transmissive for light. For instance light transmissive fibers 321 may be used as wefts 221. Optionally, instead of or in addition to the wefts 221, also the warps 222 may be replaced by light transmissive fibers 321. As will be clear to a person skilled in the art, depending on the transmissive fiber used, only part of the wefts 221 and/or warps 222 may be replaced by light transmissive fibers 321. The distribution of light transmissive fibers 321 over the carpet unit 200 may be even, but may also be uneven. For instance, when an uneven distribution is used (not depicted), one or more first areas with a higher transmission and one or more second areas with lower or normal transmission may be provided. Especially, the first area(s) and the light source(s) 10 may be aligned to each other.

Hence, in this embodiment, the light transmission of the axminster carpet unit is further increased by using for instance a weft that has a higher light transmission than normal wefts. For example, a suitable weft yarn may be an optical fiber, for example made of silica, which is a highly transparent material. However, also other materials may be used, as long as the transparency is higher than the commonly used jute weft yarns.

In another embodiment (not depicted), a transparent material as tuft yarn is inserted with optionally a short length. This embodiment may be an alternative embodiment or may be combined with other embodiments described herein.

Figure 3C:
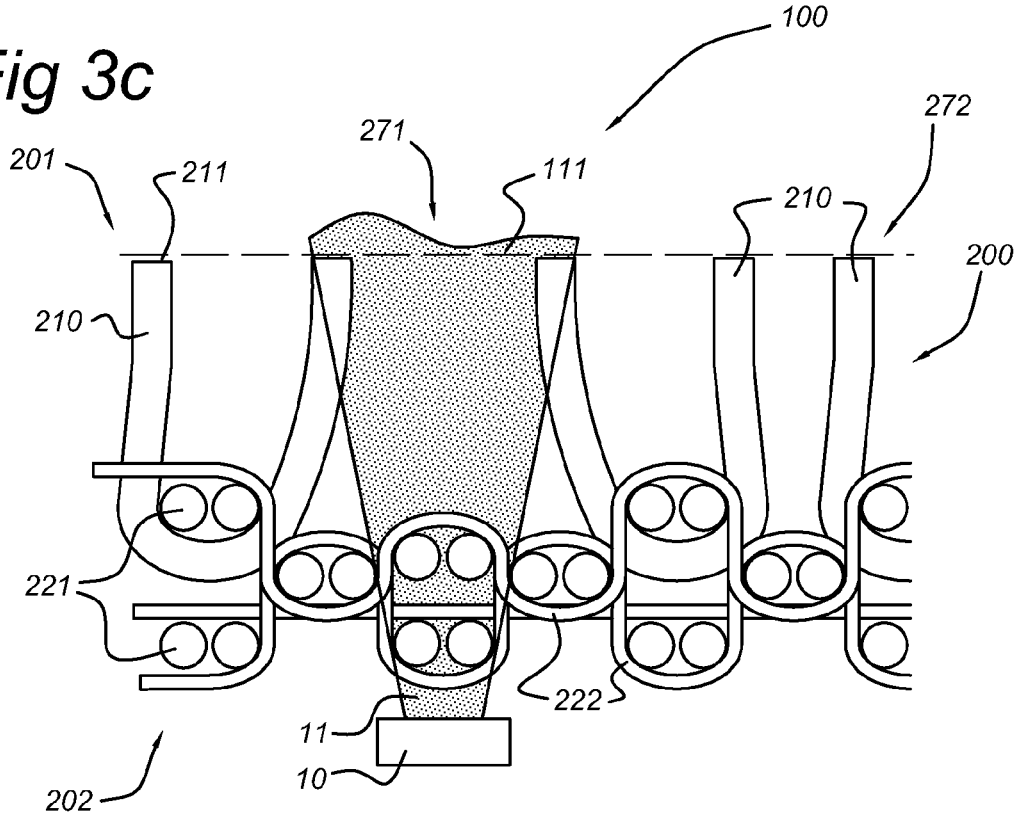

FIG. 3*c* schematically depicts an embodiment wherein (here) one tuft yarn 210 is left out. Of course, more than one tuft yarn 210 may be left out. In this way, the carpet unit 200 comprises a first area 271 with a first tuft yarn density and second area 272 with a second tuft yarn density, the first tuft yarn density being smaller than the second tuft yarn density. Especially, the first area 271 and the light source 10 may be aligned to each other, as is here depicted for the left light source 10. This schematic drawing 3*c* does not take into account that the density may be reduced in such a small extent, that the user face 201 is substantially or entirely intact, while nevertheless improving transmission of the light source light 11. See further also FIG. 3*e* below. Hence, in an embodiment the woven structure is such that a tuft yarn has been left out of the woven structure in at least one location above the light source. This may not be possible with all woven carpets, but axminster may allow every individual tuft yarn to be placed or not placed. If this is done, the appearance of the carpet does not change, but the light transmission may be increased substantially. For example, if one yarn from the carpet in FIG. 2*c* (see above) would be removed, the appearance of the carpet would not be substantially affected. It may in an embodiment be beneficial to combine this embodiment with the former, i.e. leave out one or more tuft yarns and introduce instead thereof tuft yarns that are transparent, optionally with a shorter length.

Figure 3D:
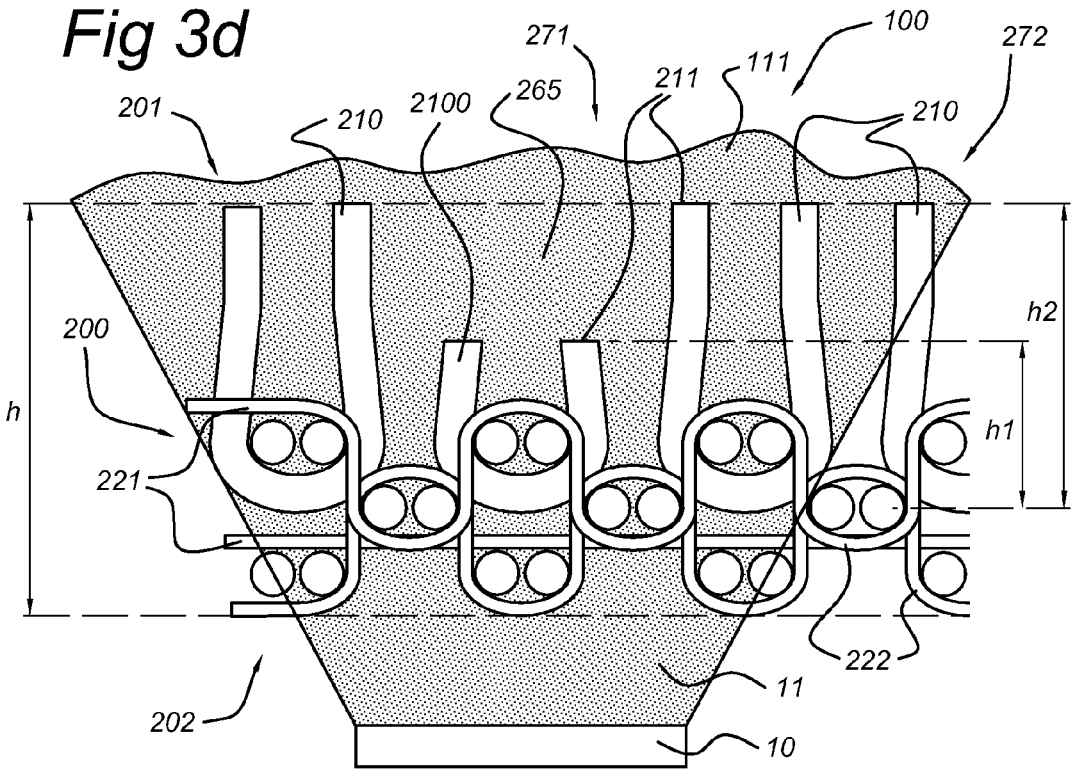

FIG. 3*d* schematically depicts an embodiment wherein the light source 10 is arranged upstream of a tuft yarn 210 having a reduced tuft yarn length relative to the user face 201. Here, an embodiment is provided wherein the carpet unit 200 comprises a first area 271 with one or more tuft yarns 210 of a first tuft yarn length h1 and second area 272 with tuft yarns 210 of a second tuft yarn length h2, the first tuft yarn length h1 being smaller than the second tuft yarn length h2, wherein the first area 271 and the light source 10 are aligned to each other. Again, in this way transmission of light source light 11 through the carpet unit 200 may be facilitated, especially through the first area. Hence, in an embodiment the light transmission may be increased by applying certain tuft yarns which are cut at a shorter length. In this way the light transmission is improved without the risk to affect the robustness of the carpet that might be caused by the absence of certain tufts.

As will be clear to the person skilled in the art, the carpet unit arrangement 100 may comprise a plurality of light sources 10 and the carpet unit may comprise a plurality of first sections 271, wherein the plurality of light sources 10 and the plurality of first sections are aligned to each other. This may apply to both the embodiment schematically depicted in FIG. 3*c* as well as the embodiment schematically depicted in FIG. 3*d* (but also the embodiment schematically depicted in 3*b*, see notes on uneven distribution of transmissive fibers).

Figure 3E:
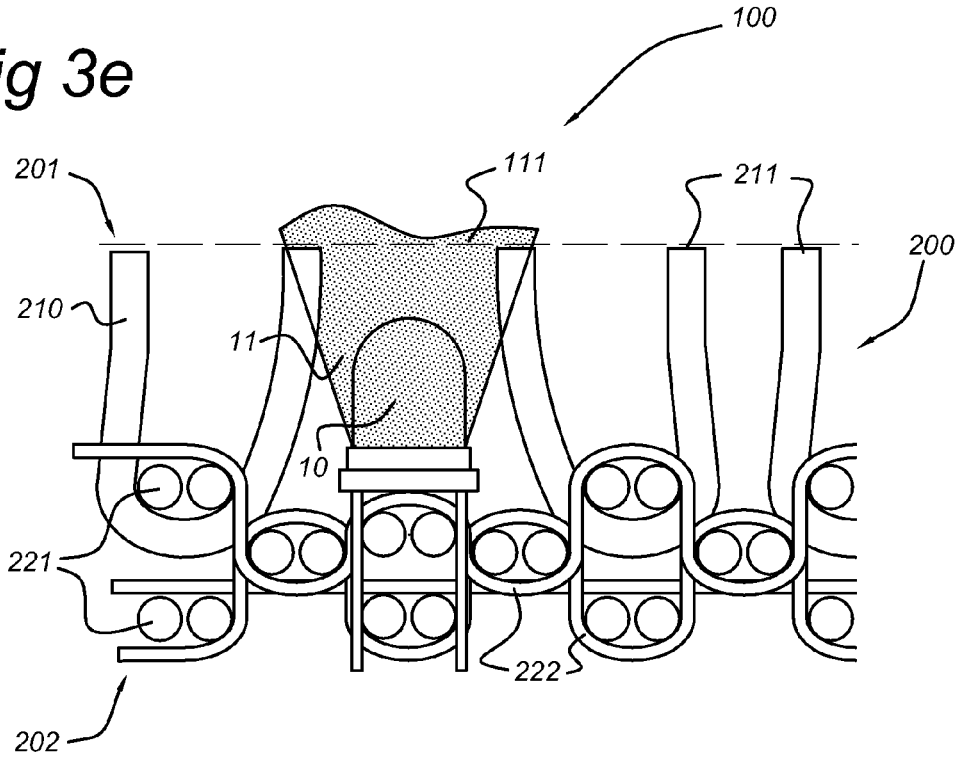

FIG. 3*e* schematically depicts an embodiment wherein the light source 10 is embedded in the carpet unit 200. In this embodiment, the light source 10 is arranged between adjacent tuft yarns 210. For instance, one or more adjacent tuft yarns 210 may not be introduced in the weft-warp structure, i.e. the weave 220, and instead thereof, the light source 10 may be arranged at the positions where otherwise one or more tuft yarns 210 would be arranged. Especially a LED as light source 10 is suitable, because of its dimensions. Note again that this schematic drawing 3*e* does not take into account that the number of tuft yarns 210 may be reduced in such a small extent, that the user face 201 is substantially or entirely intact, while nevertheless allowing space for the light source light 11. Hence, in an embodiment, the light source may be integrated into the carpet unit (structure). For instance, a 3-mm LED lamp may be placed in the location of a non-placed tuft yarn. In another example, the LED, such as a 3-mm LED, may be mounted on top of the weft before weaving. As indicated above, in this embodiment, the carpet unit 200 and the carpet unit arrangement 100 are in fact one and the same item.

Figure 3F:
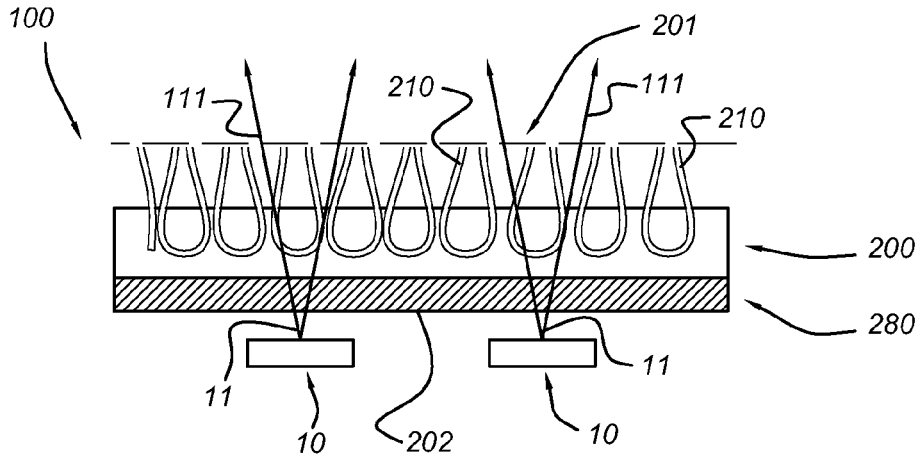

FIG. 3*f* schematically depicts an embodiment wherein the carpet unit 200 further comprises an adhesive containing backing 280. The adhesive containing backing 280 may be transmissive for light 11 of the light source 10, and may thereby facilitate transmission through the carpet unit 200 to provide carpet unit arrangement light 111. Hence, in an embodiment, a light transmissive adhesive may be used on the backside of the carpet unit. For example the filler content of the adhesive can be reduced in order to improve light transmission.

With the invention, a luminance of greater than 1 $Cd/m^2$ can be achieved from the user face 201 when the source(s) are switched on. It may even be able to have a luminance >2 $Cd/m^2$, or even >10 $Cd/m^2$, or >100 $Cd/m^2$.

The invention claimed is:

1. A carpet unit arrangement comprising:

an axminster-type carpet tile, said carpet tile having a user face formed by carpet tuft yarns and an opposite back face, and at least one light source embedded in and residing completely within the carpet tile, wherein, when seen in a direction from the user face to the back face, the light source is arranged behind the user face and in front of the back face of the carpet tile, and the light source is configured to emit light downstream of the user face of the carpet tile.

2. The carpet unit arrangement according to claim 1, wherein the light source is arranged between adjacent tuft yarns.

3. The carpet unit arrangement according to claim 1, wherein the carpet tile comprises a plurality of wufts and warps, and wherein one or more wefts comprise one or more light transmissive fibers.

4. The carpet unit arrangement according to claim 1, wherein the carpet tile comprises a first area with a first tuft yarn density and second area with a second tuft yarn density, the first tuft yarn density being smaller than the second tuft yarn density, wherein the first area and the light source are aligned to each other.

5. The carpet unit arrangement according to claim 1, wherein the carpet tile comprises first area with one or more tuft yarns of a first tuft yarn length and second area with tuft yarns of a second tuft yarn length, the first tuft yarn length being smaller than the second tuft yarn length, wherein the first area and the light source are aligned to each other.

6. The carpet unit arrangement according to claim 1, further comprising an adhesive containing backing, wherein the adhesive containing backing is transmissive for light of the light source.

* * * * *